US005957738A

United States Patent [19]

Schryer

[11] Patent Number: 5,957,738

[45] Date of Patent: Sep. 28, 1999

[54] EYELET TERMINAL WITH RETAINER

[75] Inventor: Paul Douglas Schryer, Canton, Mich.

[73] Assignee: Yazaki Corporation, Tokyo, Japan

[21] Appl. No.: 08/936,009

[22] Filed: Sep. 23, 1997

[51] Int. Cl.[6] ..... H01R 11/11

[52] U.S. Cl. ..... 439/883; 411/533

[58] Field of Search ..... 439/860, 939, 439/883, 775, 815, 92, 96, 97, 825, 835, 844, 853; 411/508, 509, 510, 517–521, 525, 533, 922

[56] References Cited

U.S. PATENT DOCUMENTS

| | | | |
|---|---|---|---|
| 2,758,498 | 8/1956 | Johnson | 411/508 |
| 3,601,786 | 8/1971 | Brubaker | 439/883 |
| 3,722,037 | 3/1973 | Jaeger | 411/508 |
| 4,015,328 | 4/1977 | McDonough | 439/77 |
| 4,747,738 | 5/1988 | Duran | 411/353 |
| 4,943,247 | 7/1990 | Wise | 439/883 |
| 4,973,212 | 11/1990 | Jacobs | 411/508 |
| 4,983,133 | 1/1991 | Van Scyoc et al. | 439/860 |
| 5,006,741 | 4/1991 | Schott | 363/144 |
| 5,489,177 | 2/1996 | Schmidt, Jr. | 411/533 |
| 5,529,509 | 6/1996 | Hayes et al. | 439/288 |

FOREIGN PATENT DOCUMENTS

0452929B1 11/1995 European Pat. Off. .

*Primary Examiner*—Steven L. Stephan
*Assistant Examiner*—Brian J. Biggi
*Attorney, Agent, or Firm*—Young & Basile, P.C.

[57] ABSTRACT

An eyelet terminal is secured to the surface of a grounding member by a resilient plastic retainer passing through the eyelet and through a hole in the member. The eyelet has an annular sleeve which fits inside the hole in the member and a plurality of fingers extending radially outward from the sleeve to contact the surface of the member. After the eyelet is so positioned, the retainer is pushed through the sleeve to urge the fingers into planar contact with the surface. The retainer has a resiliently deformable flange at its lower end which is compressed inwardly as it passes through the sleeve and expands outwardly again on the opposite side of the sleeve and member, and a cap at its upper end which fits over the fingers of the eyelet to protect against contamination. The fingers are canted downwardly out of the plane of the sleeve as they extend away from the sleeve, so that the tips of the fingers contact the surface of the member first as the sleeve is inserted into the hole and scrape against the surface when they are flattened by insertion of the retainer.

20 Claims, 2 Drawing Sheets

EYELET TERMINAL WITH RETAINER

FIELD OF THE INVENTION

This invention relates in general to eyelet terminals and more specifically to a two-piece terminal assembly for securing an electrical wire to a surface.

BACKGROUND OF THE INVENTION

Eyelet terminals are used in many electrical systems, most commonly to connect electrical wires to an electrical ground. An eyelet terminal is typically a flat ring of electrically conductive material having an arm extending radially therefrom for connection to the end of a length of wire by crimping. In an automotive vehicle electrical system, the grounding surface is usually a thin sheet of metal such as a vehicle body panel, and the eyelet terminal is secured to the surface of the panel by inserting a bolt through the ring and through a hole in the panel. The bolt is threaded into engagement with a nut that is welded onto the surface of the panel opposite the eyelet terminal and tightened to urge the ring firmly into physical and electrical contact with the panel.

Installation of such an eyelet terminal on the vehicle at the assembly plant is costly because of the time required and because a tool, such as a pneumatic wrench, is required to tighten the bolt into engagement with the nut. Furthermore, only the lower surface of the ring makes electrical contact with the panel. If the bolt loosens due to improper tightening during assembly, the surface of the ring may become partially or completely separated from the panel, causing an intermittent or nonexistent grounding.

SUMMARY OF THE INVENTION

It is an object of this invention to provide an eyelet terminal which increases the reliability and quality of electrical contact between the terminal and a surface.

Another object of the invention is to provide a terminal which may be secured to a surface without the use of any tool.

According to the present invention, these objectives are achieved by an eyelet terminal which is held in contact with a member such as a body panel by a retainer clip passing through the eyelet and a hole in the member. The eyelet comprises a substantially annular sleeve which fits inside the hole in the member and a plurality of fingers which extend radially outward from the sleeve to contact the surface of the member. After the eyelet is positioned so that the sleeve is within the hole in the member and the fingers are in planar contact with the surface of the member adjacent the hole, the retainer is pushed through the sleeve.

The retainer comprises a cylindrical shaft which is of large enough diameter to expand the sleeve and urge it outwardly into contact with the interior of the hole in the member, a resiliently deformable tip at the lower end of the shaft and which is compressed inwardly as it passes through the sleeve and expands outwardly again on the opposite side of the sleeve and member to hold the eyelet in place within the hole, and a cap at the upper end of the shaft which extends radially outward beyond and fits over the fingers of the eyelet to cover and protect the eyelet from moisture, dirt or other contamination.

In a preferred embodiment of the invention, the fingers are canted downwardly out of the plane defined by the sleeve as they extend away from the sleeve, so that the tips of the fingers contact the surface of the member first as the sleeve is inserted into the hole. When the retainer is inserted through the sleeve, the cap urges the fingers flat against the upper surface of the member and the edges at the tips of the fingers scrape against the surface of the member to cut through any contamination that may be present on the surface of the member and thus enhance electrical contact.

DETAILED DESCRIPTION OF THE PREFERRED EMBODIMENT

Figure 1:
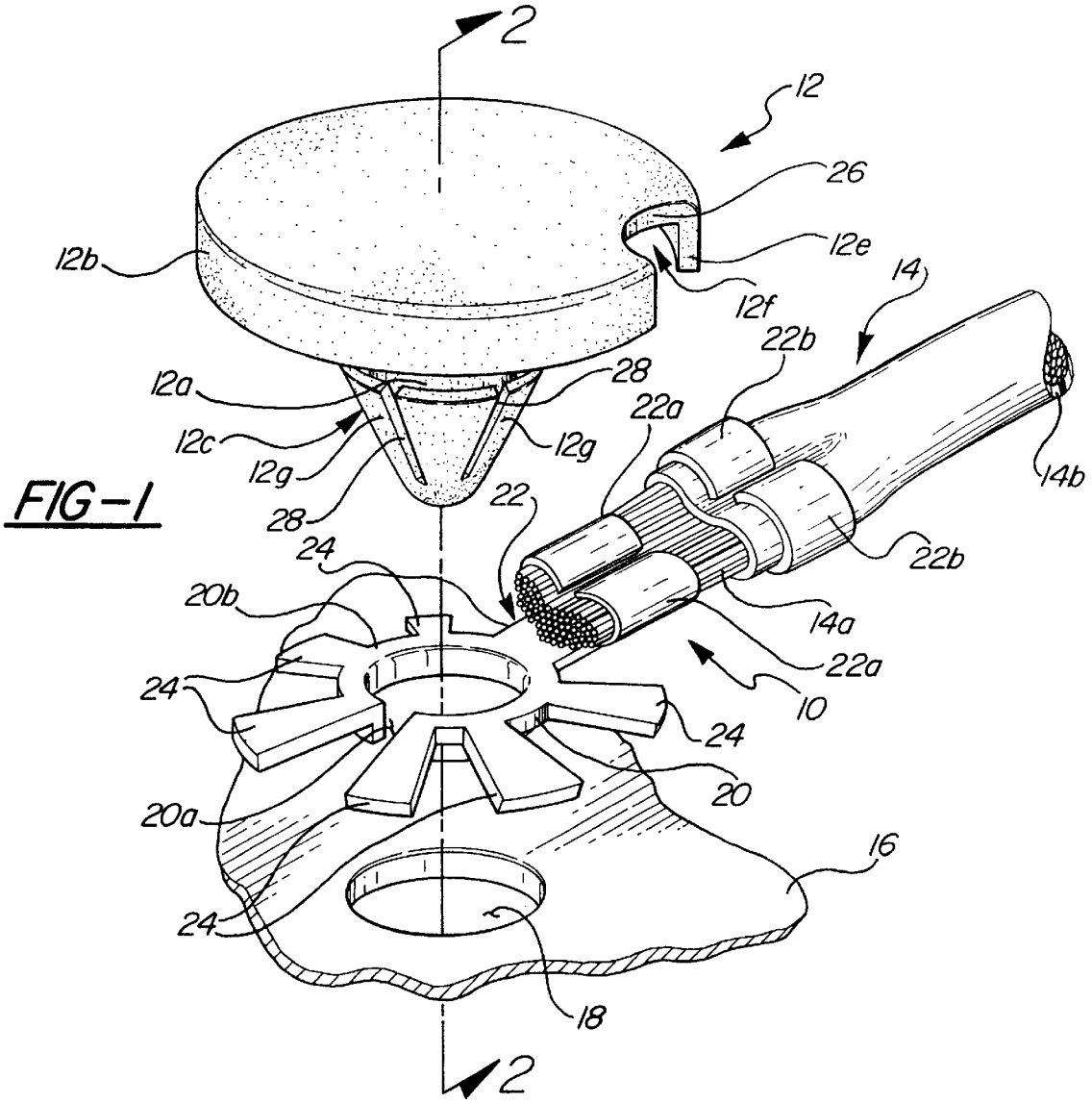
FIG. 1 is a perspective view of an eyelet terminal and retainer according to the present invention.
Figure 2:
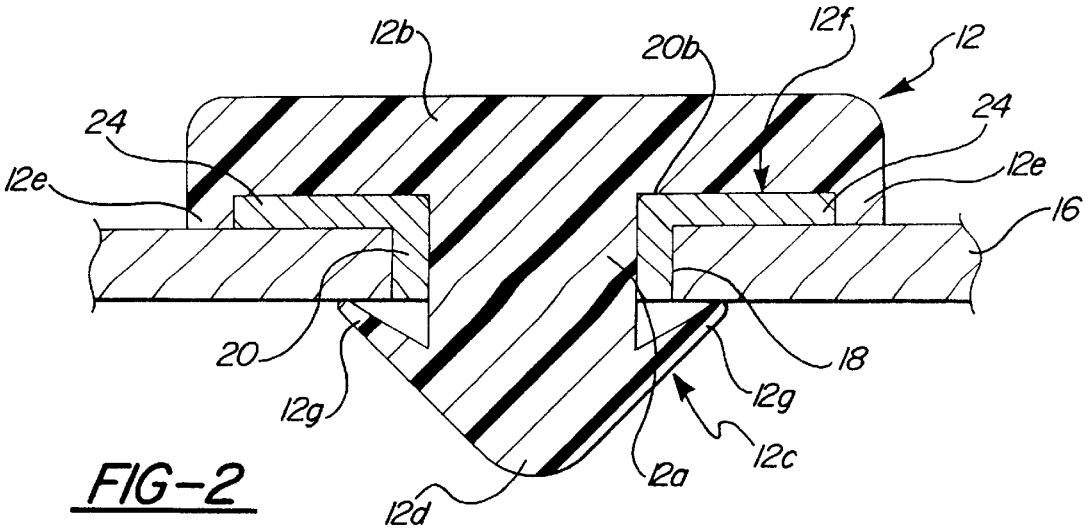
FIG. 2 is a cross-sectional view of the eyelet terminal inserted through a hole in a panel and held in place by the retainer.
Figure 3:
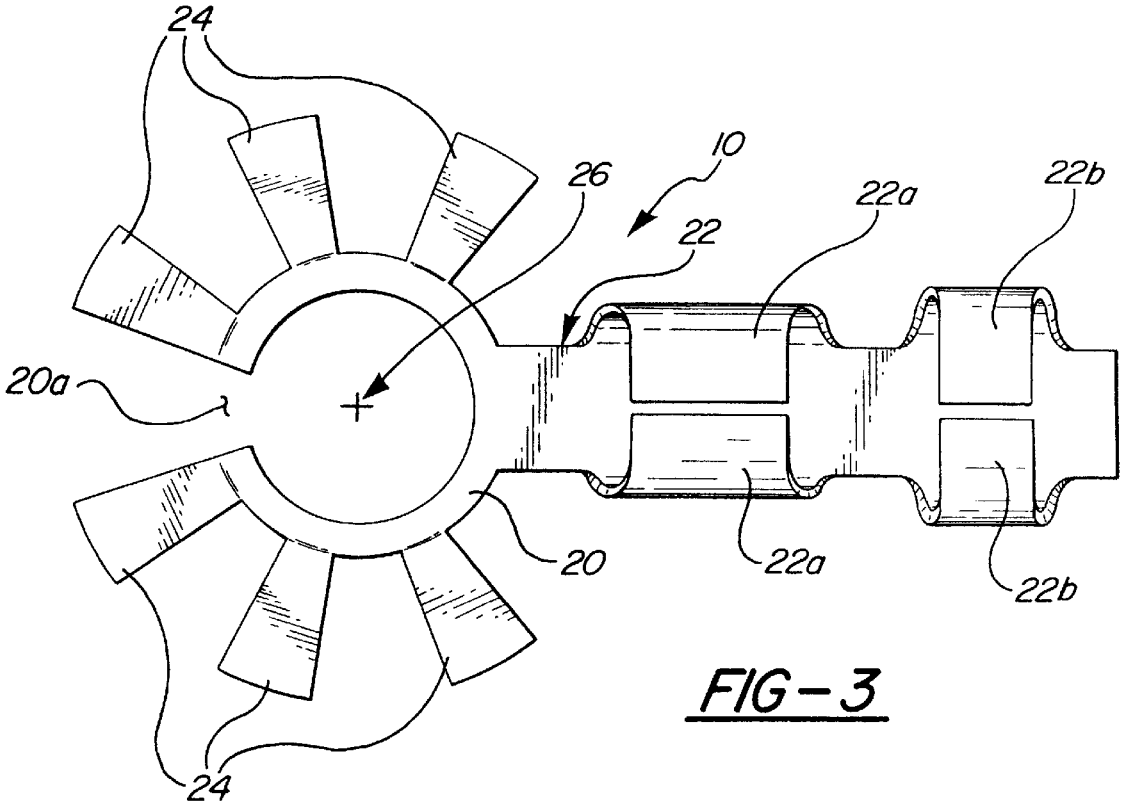
FIG. 3 is a top view of the eyelet terminal.

Referring to FIGS. 1 and 2, an eyelet terminal 10 and retainer 12 according to the present invention are illustrated. The eyelet terminal 10 may be used, for example, to connect an electrical wire 14 related to an electrical system or component (not shown) to a grounding surface such as a metal body panel (see FIG. 2) of an automotive vehicle. The eyelet terminal 10 is secured to the panel 16 by inserting the retainer 12 through the eyelet and through a hole 18 in the panel 16, as is described in greater detail hereinbelow. The wire 14 generally comprises a core 14*a* of conductive strands and an insulating cover 14*b*.

The terminal 10 is formed from an electrically conductive metal and comprises a substantially annular sleeve 20 having a break 20*a* in its circumference, a wire mounting stem 22 attached to the sleeve and extending therefrom at a point opposite from the break, and a plurality of flat fingers 24 extending radially outward from the sleeve.

The stem 22 includes a first pair of bendable tabs 22*a* for wrapping around and crimping to the core 14*a* of the wire 14 to make electrical contact therewith, and a second pair of tabs 22*b* for wrapping around and crimping to the cover 14*b* of the wire 14.

Figure 4:
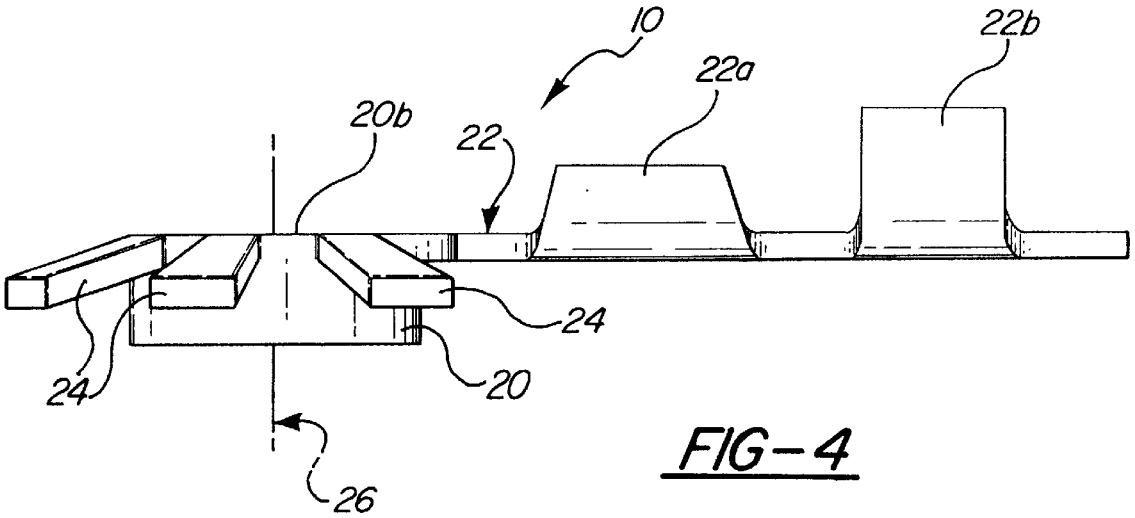
FIG. 4 is a side view of the eyelet terminal.

The fingers 24 are attached to the sleeve 20 at points lying on a plane normal to a central axis 25 of the sleeve, preferably along an upper edge 20*b* of the sleeve. The fingers 24 are canted downwardly out of the plane at which they are attached to the sleeve 20, as is best seen in FIG. 4.

The retainer 12 is preferably formed of a plastic polymer and comprises a cylindrical shaft 12*a*, a cap 12*b* attached to an upper end of the shaft and extending radially outward therefrom, and a flange 12*c* attached to the lower end of the shaft. The shaft 12*a* has an outside diameter slightly greater than the inside diameter of the sleeve 20, and the lower end 12*d* of the shaft is pointed or rounded. The cap 12*b* has a downwardly projecting rim 12*e* around its outermost edge to form an annular channel 12*f* on the underside of the cap between the rim and the shaft 12*a*. A generally semi-circular notch 26 is formed in the periphery of the cap 12*b*.

The flange 12*c* extends radially outward around the circumference of the shaft 12*a* and angles from the lower end to the upper end of the shaft, giving the flange an arrowhead appearance when viewed from the side, as best seen in FIG. 2. A plurality of slots 28 extend from the outer edge of the flange 12*c* downward toward the lower end of the shaft, dividing the flange into a plurality of lobes 12*g*.

The eyelet terminal 10 is attached to the wire 14 by crimping the first and second pairs of tabs 22*a*, 22*b* around the wire core 14*a* and cover 14*b* respectively, as is well known in the art. The sleeve 20 is then inserted into the hole 18 in panel 16. It is preferable that the sleeve 20 be sized such that its outer diameter in an undeformed state is slightly greater than the inside diameter of the hole 18. Accordingly, the sleeve 20 must be compressed radially inward a small amount in order for it to fit into the hole 18. This inward compression is facilitated by the existence of the break 20*a* in the circumference of the sleeve, and is easily accomplished manually by squeezing the eyelet between one's fingers. Once the sleeve 20 is within the hole 18, it is released and expands outwardly to be in gripping contact with the inner surface of the hole 18. Because the fingers 24 are canted slightly downward, when the sleeve 20 is first placed in the hole 18 only the distal ends of the fingers 24 are in contact with the upper surface of the panel 16, and the sleeve 20 is not fully inserted into the hole 18.

To complete the fastening of the eyelet terminal 10 to the panel 16, the lower end of the retainer shaft 12*a* is placed against the upper edge 20*b* of the sleeve and the retainer 12 is urged downwardly through the interior of the sleeve 20. This is easily accomplished manually by pressing downward on the top of the cap 12*b* with one's fingers. The lobes 12*g* of flange 12*c* bend inwardly toward the shaft 12*a* as the flange passes through the interior of the sleeve 20, and the flange is sufficiently resilient to expand outwardly again after clearing the lower edge of the sleeve 20 and hole 18. The slots 28 contribute to the flexibility of the flange 12*c*. As the retainer 12 reaches the point of full insertion, the annular channel 12*f* in the lower surface of the cap 12*b* fits over the fingers 24, the rim 12*e* encircles the outer periphery of the fingers, and the cap flattens the fingers against the surface of the panel 16, as seen in FIG. 2.

To achieve the best electrical contact between the terminal 10 and the panel 16, the retainer shaft 12*a* should be of such a length that the axial distance between the underside of the cap 12*b* and the top-most edge of the flange 12*c* is less than the combined thicknesses of the panel 16 and the fingers 24. When this is the case and the retainer 12 is fully inserted through the eyelet 10, the flange 12*c* elastically deforms radially outward as it contacts the lower surface of the panel 16. The resilient nature of the flange 12*c* causes it to generate a spring force which pulls the cap 12*b* downward against the fingers 24, holding them substantially flat against the upper surface of the panel adjacent the hole 18. Note that the notch 26 in the cap 12*b* is intended to be placed in alignment with the wire mounting stem 22 so that there is no interference which may prevent the cap 12*b* from fitting around the eyelet terminal 10.

The outer diameter of the retainer shaft 12*a* may be formed to be sufficiently large that when it is within the sleeve 20 it urges the sleeve outwardly, thereby adding to the amount of surface contact pressure between the outer surface of the sleeve and the inner surface of the hole 18. This added surface contact pressure enhances the electrical contact between the terminal 12 and the panel 16.

Insertion of the retainer 12 through the eyelet 10 flattens the fingers 24 against the upper surface of the panel 16 to create additional surface contact between the eyelet terminal 10 and the panel 16 and so improve the electrical contact. As the fingers 24 are flattened, the lower edges of their distal ends that make initial contact with the panel 16 move radially outward a small amount, and so scrape against the upper surface of the panel to penetrate any paint or corrosion and "bite" into the surface of the panel 16 slightly. This increases the quality of the electrical contact between the terminal 10 and the panel 16. If desired, the undersides of the fingers 24 may also be serrated, knurled, or otherwise textured in order to further improve the electrical contact with the panel 16.

The retainer 12 replaces the conventional bolt and nut used to secure conventional eyelet terminals to their grounding surfaces, taking less time to install and being installable without the use of any tools. The retainer 12 also helps protect the eyelet terminal 10 against corrosion and contamination by substantially covering the sleeve 20 and fingers 24 where the electrical contact takes place.

Whereas a preferred embodiment of the invention has been illustrated and described in detail, it will be apparent that various changes may be made in the disclosed embodiment without departing from the scope or spirit of the invention.

The invention claimed is:

1. Apparatus for achieving electrical connection between a conductor and a member having a hole passing between opposite first and second surfaces of the member, the hole defining an annular inner surface of the member, the apparatus comprising:

an eyelet terminal for connection to the conductor and having a substantially annular sleeve for insertion into the hole to make electrical contact with the inner surface of the member and surface contact means extending radially outward from the sleeve for contacting the first surface of the member adjacent the hole when the sleeve is in the hole; and a retainer for insertion through the eyelet terminal and the hole and having means for urging the sleeve radially outward into contact with the inner surface of the member and means for urging the surface contact means into contact with the first surface of the member.

2. The apparatus according to claim 1 wherein the sleeve has a break in its circumference.

3. The apparatus according to claim 1 wherein the surface contact means comprises a plurality of fingers spaced circumferentially around the sleeve.

4. The apparatus according to claim 3 wherein the sleeve has a central axis, the fingers are attached to the sleeve at points lying on a plane normal to the central axis, and at least one of the fingers is canted out of the plane such that an end of the at least one finger distal from the sleeve contacts the first surface of the member when the sleeve is in the hole.

5. The apparatus according to claim 1 wherein the surface contact means has a lower side for contacting the first surface of the member and an opposite upper side, and the retainer urging means comprises a cap adjacent a first end of the retainer for contacting the upper side of the surface contact means and resilient means adjacent an opposite second end for contacting the second surface of the member, the resilient means being deformable to a compressed configuration to fit through the sleeve and resiliently expandable to extend radially outward beyond the hole in the member and contact the second surface of the member.

6. The apparatus according to claim 1 wherein the means for urging the sleeve radially outward comprises a shaft insertable through the sleeve.

7. Apparatus for achieving electrical connection between a conductor and a member having a hole passing therethrough between opposite first and second surfaces of the member, the hole defining an annular inner surface of the member, the apparatus comprising:

an eyelet terminal for connection to the conductor and having a substantially annular sleeve for insertion into the hole to make electrical contact with the inner surface of the member and a plurality of fingers projecting radially outward from the sleeve to make contact with the first surface of the member adjacent the hole when the sleeve is in the hole; and a retainer having a shaft for insertion through the sleeve and of sufficiently large diameter to urge the sleeve outwardly into contact with the inner surface of the member, a cap at a first end of the shaft to contact the fingers and a flange extending radially outward from a second end of the shaft to contact the second surface of the member and thereby retain the eyelet terminal in engagement with the member.

8. The apparatus according to claim 7 wherein the sleeve has a central axis, the fingers are attached to the sleeve at points defining a plane normal to the central axis, and at least one of the fingers is canted out of the plane such that an end of the at least one finger distal from the sleeve contacts the first surface of the member when the sleeve is in the hole.

9. The apparatus according to claim 7 wherein the cap substantially covers the fingers and urges the fingers against the first surface of the member.

10. The apparatus according to claim 7 wherein the flange is deformable to a compressed configuration to fit through the sleeve and resiliently expandable to extend radially outward beyond the hole in the member.

11. The apparatus according to claim 7 wherein the sleeve has a break in its circumference.

12. Apparatus for achieving electrical connection between a conductor and a member having a hole passing therethrough between opposite first and second surfaces of the member, the apparatus comprising:

a terminal having a first portion for fitting inside of the hole and making electrical contact with an interior surface of the hole, and a second portion extending radially outward from the first portion over the first surface adjacent the hole, said terminal having a central opening; and a retainer for insertion through the central opening and the hole to retain the terminal in contact with the member and urge the first portion of the eyelet terminal radially outward into contact with the interior surface of the hole.

13. The apparatus according to claim 12 wherein the terminal comprises a substantially annular sleeve and a plurality of fingers spaced circumferentially around the sleeve and extending radially outward therefrom.

14. The apparatus according to claim 13 wherein the sleeve has a central axis, the fingers are attached to the sleeve at points defining a plane normal to the central axis, and at least one of the fingers is canted out of the plane such that an end of the at least one finger distal from the sleeve contacts the first surface of the member when the sleeve is in the hole.

15. The apparatus according to claim 13 wherein the sleeve has a break in its circumference.

16. The apparatus according to claim 12 wherein the terminal has a lower side for contacting the first surface of the member and an opposite upper side and the retainer comprises a cap for contacting the upper side of the terminal and resilient means for contacting the second surface of the member, the resilient means being deformable to a compressed configuration to fit through the central opening and resiliently expandable to extend radially outward beyond the hole in the member.

17. The apparatus according to claim 16 wherein the retainer further comprises a shaft connecting the cap and the resilient means, the shaft being of great enough diameter relative to an inner diameter of the sleeve to urge the sleeve radially outward into contact with the member.

18. A terminal for achieving electrical connection between a conductor and a member having a hole passing therethrough between opposite first and second surfaces of the member, the hole defining an annular inner surface of the member, the terminal comprising:

an eyelet for making electrical contact with the first surface of the member in an area surrounding the hole and for receiving a retainer therethrough to secure the terminal to the member;

means extending radially outward from the eyelet for connecting the terminal to the conductor; and a substantially annular sleeve extending in an axial direction from the eyelet for insertion into the hole to make electrical contact with the inner surface of the member, the sleeve having means for allowing the sleeve to be compressed radially inward to fit into the hole and to spring radially outward into contact with the inner surface of the member.

19. The terminal according to claim 18 wherein the eyelet comprises a plurality of fingers projecting radially outward from the sleeve.

20. The terminal according to claim 19 wherein the sleeve has a central axis, the fingers are attached to the sleeve at points lying on a plane normal to the central axis, and at least one of the fingers is canted out of the plane such that an end of the at least one finger distal from the sleeve contacts the first surface of the member when the sleeve is in the hole.

* * * * *